US008205269B2

(12) United States Patent
Anderson

(10) Patent No.: US 8,205,269 B2
(45) Date of Patent: Jun. 26, 2012

(54) GOLF GLOVE

(76) Inventor: Gary Anderson, Yalaha, FL (US)

( * ) Notice: Subject to any disclaimer, the term of this patent is extended or adjusted under 35 U.S.C. 154(b) by 148 days.

(21) Appl. No.: 12/769,430

(22) Filed: Apr. 28, 2010

(65) Prior Publication Data

US 2011/0265244 A1 Nov. 3, 2011

(51) Int. Cl.
*A41D 19/00* (2006.01)

(52) U.S. Cl. ..... 2/161.2; 2/163; 473/205

(58) Field of Classification Search ..... 2/161.2, 2/161.3, 161.4, 161.6, 163, 161.1, 917, 159, 2/160, 161.5, 161.8, 16, 19, 21; 473/205; 441/57

See application file for complete search history.

(56) References Cited

U.S. PATENT DOCUMENTS

| | | | | |
|---|---|---|---|---|
| 1,584,304 | A * | 5/1926 | Kennedy | 2/16 |
| 2,928,102 | A * | 3/1960 | Canausa | 2/161.2 |
| 3,100,302 | A * | 8/1963 | Billings | 2/161.2 |
| 3,707,730 | A * | 1/1973 | Slider | 2/161.1 |
| 3,740,766 | A | 6/1973 | Kobylarz | |
| 4,164,043 | A | 8/1979 | Fujita | |
| 4,453,275 | A | 6/1984 | Kawada | |
| 4,665,565 | A | 5/1987 | Odom | |
| 4,720,875 | A * | 1/1988 | Latina et al. | 2/19 |
| 4,827,535 | A * | 5/1989 | Socey | 2/158 |
| 4,882,787 | A | 11/1989 | Hull | |
| 5,028,050 | A * | 7/1991 | Freyer | 473/205 |
| 5,414,868 | A | 5/1995 | Crawford | |
| 5,590,421 | A * | 1/1997 | Craner | 2/161.7 |
| 5,715,539 | A * | 2/1998 | Benecki et al. | 2/160 |
| 5,765,228 | A * | 6/1998 | Bieling | 2/158 |
| 6,154,885 | A | 12/2000 | Kobayashi | |
| 6,195,804 | B1 * | 3/2001 | Fraser | 2/161.2 |
| 6,212,687 | B1 | 4/2001 | Kwon | |
| D446,610 | S * | 8/2001 | Rosenberg | D29/116.2 |
| 6,363,535 | B1 | 4/2002 | Landis | |
| 6,732,377 | B1 * | 5/2004 | Wilkinson | 2/161.4 |
| 6,745,403 | B2 * | 6/2004 | Sajovic | 2/161.8 |
| 2004/0187182 | A1 * | 9/2004 | Carraway | 2/21 |
| 2006/0015983 | A1 | 1/2006 | Kim | |
| 2008/0282445 | A1 * | 11/2008 | Taliento et al. | 2/161.3 |
| 2009/0183295 | A1 * | 7/2009 | Rhee | 2/161.2 |
| 2011/0179550 | A1 * | 7/2011 | Watanabe | 2/160 |

* cited by examiner

*Primary Examiner* — Amy Vanatta

(74) *Attorney, Agent, or Firm* — Daniel Law Offices, P.A.; Jason T. Daniel, Esq.

(57) ABSTRACT

Disclosed herein is an improved golf glove for ensuring proper grip and alignment when worn by a user while playing golf. The glove can include several restrictors located between the thumb and fingers of the glove to prevent the fingers from separating, while still allowing the ends of each finger to move freely.

10 Claims, 2 Drawing Sheets

GOLF GLOVE

BACKGROUND

1. Field of the Invention

The present invention relates generally to sports gloves for use in golf, and more particularly for an improved golf glove for ensuring proper hand and finger alignment on a golf club.

2. Description of the Related Art

One of the most important features of a good sports swing is to ensure proper hand placement on the club so that solid contact can be made with the ball. This is particularly important in golf, where improper hand placement is a common error experienced by novice golfers. In many cases, golfers ranging from novice to professional have problems keeping proper hand and finger alignment throughout a golf swing. When the fingers move or become separated, the club can shift, resulting in a poor hit. Moreover, improper hand and finger alignment can greatly contribute to over-swinging the golf club which can result in injury to the player.

Many different devices have been proposed for assisting a golfer with proper hand alignment. For example, U.S. Patent Publication No. 2006/0015983 describes a golf glove having a strap for securing the hand to the club. U.S. Pat. No. 3,740,766 describes a glove having a single pocket for the middle, ring and little fingers to collectively grip a golf club.

Accordingly, it would be beneficial to provide an improved golf glove for ensuring proper grip placement throughout a golf swing in order to overcome the problems described above.

SUMMARY OF THE INVENTION

The present invention is directed to a sports glove for securely gripping a golf club. One embodiment of the present invention can include a palm section having an opening at a first end, a thumb section and a plurality of finger sections extending from the palm section at a second end, and a plurality of restrictors for preventing lateral separation of the thumb and finger sections.

In another embodiment, each of the restrictors can be permanent in nature while allowing the distal portions of each finger and thumb to move freely.

Yet another embodiment of the present invention can include a plurality of restrictors for providing non-permanent restriction of lateral movement in each finger and thumb while allowing the distal portions of each to move freely.

BRIEF DESCRIPTION OF THE DRAWINGS

Presently preferred embodiments are shown in the drawings. It should be appreciated, however, that the invention is not limited to the precise arrangements shown.

DETAILED DESCRIPTION OF THE INVENTION

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Although illustrated below as a left hand glove, one of skill in the art will readily understand that the inventive concepts disclosed herein pertain to both a left and a right hand glove equally. The depictions of a left hand glove are for illustrative purposes only and are not intended to be limiting upon the scope of the invention. Moreover, if desired, both a left hand glove and a right hand glove can be used in unison without departing from the spirit and scope of the invention.

Figure 1:
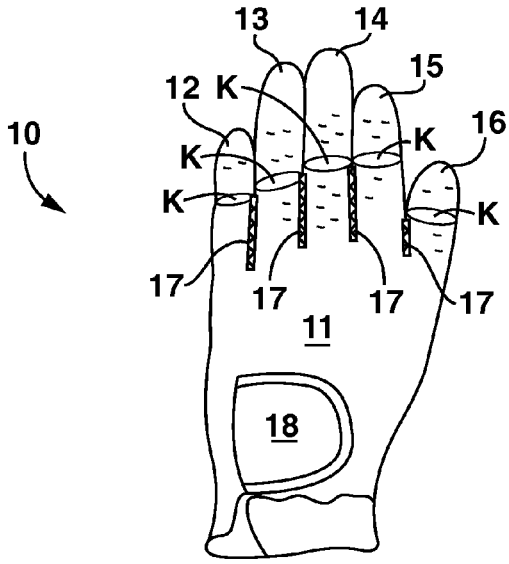
FIG. 1 is a frontal elevation of a golf glove that is useful for understanding the embodiments disclosed herein.

FIG. 1 is a front view of an improved golf glove that is useful for understanding the embodiments disclosed herein. As shown, golf glove 10 according to one embodiment can include an adjustable closing flap 18, a palm section 11, a plurality of finger sections 12-15 and a thumb section 16 extending therefrom.

The glove 10 can further include a plurality of restrictors 17 for restricting lateral (side to side) separation of the finger and thumb sections. To this end, a portion of each thumb and finger sections can be securely affixed to an adjacent finger. In a preferred embodiment, the restrictor can be constructed from thread stitched between each finger, and can extend along each finger and thumb section from the palm 11 to the knuckle K. Such an arrangement prevents lateral separation of the thumb and fingers while still allowing the distal ends of each digit to move freely past the knuckle.

Figure 2A:
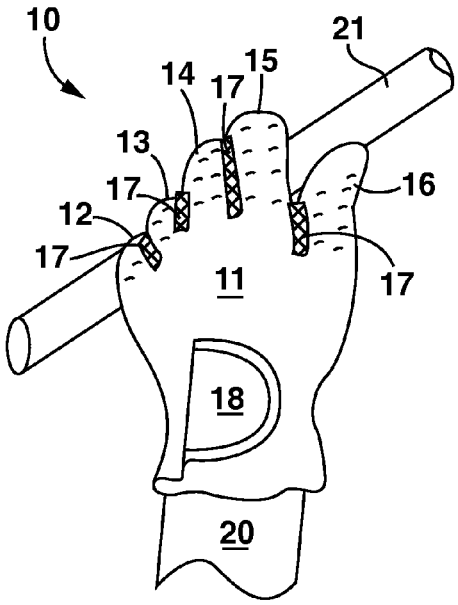
FIG. 2*a* is a top view of the glove in use, according to one embodiment of the present invention.
Figure 2B:
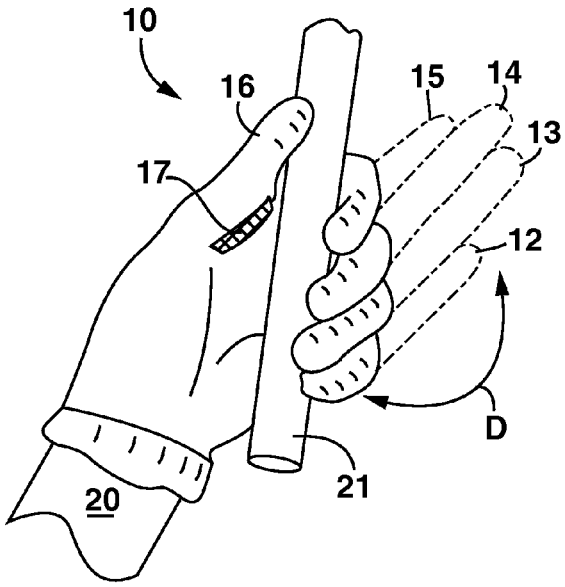
FIG. 2*b* is a bottom view of the glove in use, according to one embodiment of the present invention.

FIG. 2*a* illustrates a user 20 wearing the glove 10 having proper finger alignment when grasping a golf club 21. As shown in FIG. 2*b*, by restricting the available space between the index finger 15 and the thumb 16, the glove ensures a tight fit when the club 21 is placed therebetween. Moreover, each remaining finger is able to open and close independently (see arrow D), thus providing the user the ability to independently grip the club with each finger while maintaining proper alignment. Such a feature acts to ensure proper grip pressure and aids in the comfort of the user.

Figure 3:
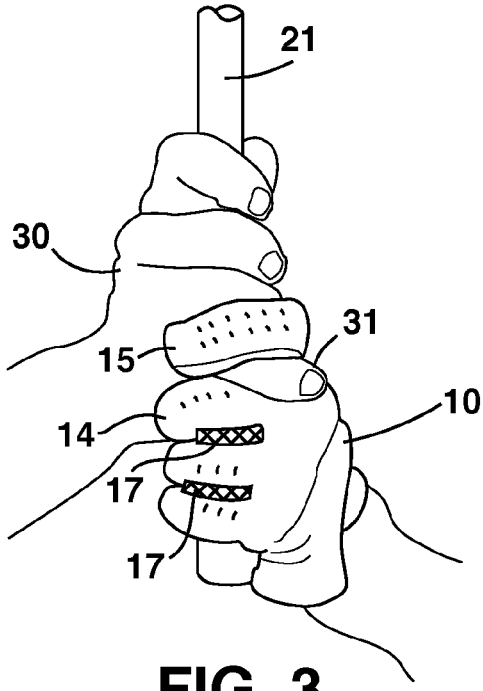
FIG. 3 is frontal view of a golfer using the invention according to one embodiment of the present invention.

FIG. 3 illustrates one embodiment of the glove 10 in use. In this embodiment, the user is holding the club 21 using both hands in a manner known as an "interlocking grip." As such, the small finger 31 of one hand (in this instance, the right hand 30, for example) is placed between the first and middle fingers of the gloved hand 10. When placed in this position, the little finger 31 can rest atop the restrained portion 17 of fingers 14 and 15 while the distal portion of finger 15 can bend atop the little finger 31. Such positioning acts to securely interlock the fingers while swinging the club without allowing lateral separation of the fingers or the hands.

Although described above as pertaining to an interlocking grip, this is for illustrative purposes only as the embodiments disclosed herein relate to any type or manner of golf grip, stance, swing and methodology.

Figure 4:
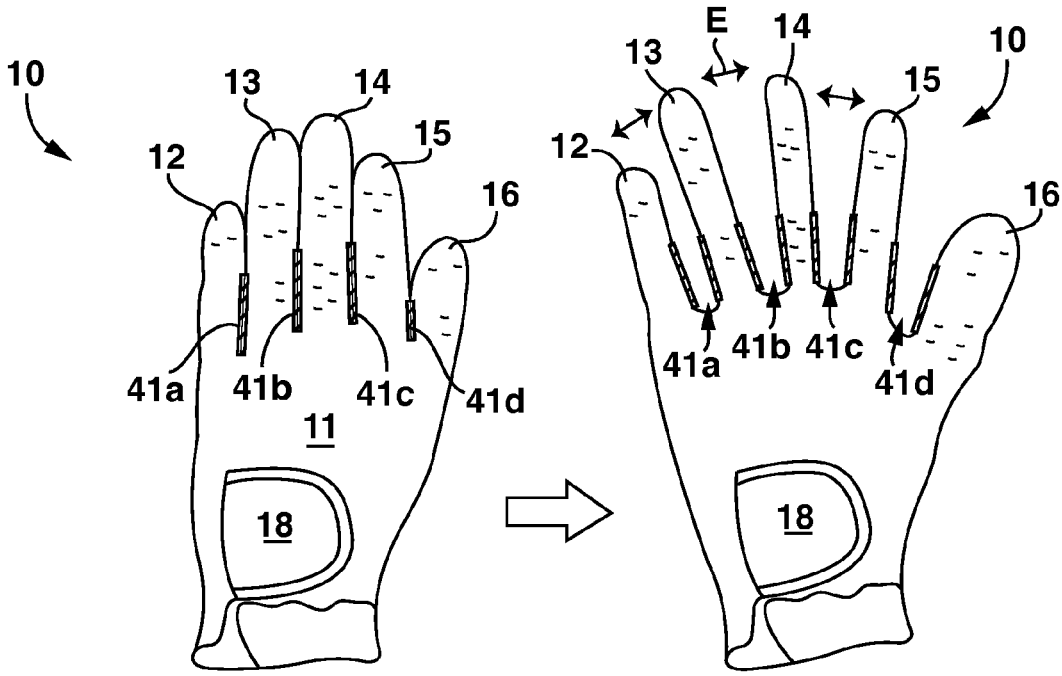
FIG. 4 is perspective view of an additional embodiment of the invention.

FIG. 4 illustrates an alternate embodiment of the golf glove 10 as described above that includes a plurality of magnetic elements 41*a*-41*d* interposed between each finger/thumb section. As shown, each of magnetic elements 41*a*-41*d* can be placed between the thumb 16 and finger sections 12-15, respectively, thus allowing a user to freely move and separate each finger (see arrow E) until such time as they are ready to grip a golf club. At this time, the user can close the fingers thus engaging the magnets in order to securely grip the club in a manner similar to that described above.

In a preferred embodiment, each of the magnetic elements can be permanently affixed within the inner lining of the glove and can be flexible so as not to impede free movement of the hand. Although described herein as magnetic elements, other materials are also contemplated such as, for example, Velcro®, zippers and compression fittings, each of which being well known in the art.

Accordingly, by securely positioning the fingers of a user utilizing a glove as described above, it is possible to prevent lateral separation of the thumb and fingers while still allowing the user to move the distal portions of each finger. To this end, when swinging a golf club, both the palm and fingers can remain securely positioned thus ensuring a smooth clean swing.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A sports glove for securely gripping a golf club, said glove comprising:

a palm section having an opening at a first end;

a plurality of finger sections extending outward from a second end of the palm section;

a thumb section extending outward from the second end of the palm section; and at least one restrictor secured to each finger and thumb, said restrictors extending from the palm section and terminating at a knuckle section of the thumb and each finger, each of the restrictors being configured to independently engage and disengage an adjacent restrictor in order to limit a lateral movement of the individual thumb and fingers of the engaged restrictors.

2. The sports glove of claim 1, wherein a distal portion of each thumb and finger section is not restricted by the restrictor.

3. The sports glove of claim 1, wherein the restrictor acts to removably join each thumb and finger section.

4. The sports glove of claim 1, wherein said glove is configured to be used on a left hand of a user.

5. The sports glove of claim 1, wherein said glove is configured to be used on a right hand of a user.

6. The sports glove of claim 1, wherein said restrictors are configured to allow unobstructed movement of the thumb and each finger when not engaged.

7. The sports glove of claim 1, wherein said restrictors are further configured to allow each of the thumb and finger sections to engage and disengage without interfering with a movement of another thumb and finger section.

8. The sports glove of claim 1, wherein each of said restrictors comprise:

one or more magnetic elements having a flexible shape configured to allow unobstructed movement of the thumb and each finger when not engaged.

9. The sports glove of claim 8, wherein each of the magnetic elements are permanently affixed within an inner lining of the glove to further allow for unobstructed movement of the thumb and each finger section.

10. The sports glove of claim 1, wherein each of said restrictors include hook and loop material having a flexible shape configured to allow unobstructed movement of the thumb and each finger when not engaged.

* * * * *